United States Patent [19]

Sanders

[11] 4,413,957

[45] Nov. 8, 1983

[54] PORTABLE, HAND HELD, HIGH PRESSURE PUMP

[76] Inventor: David H. Sanders, P.O. Box 502, Hamlin, Tex. 79520

[21] Appl. No.: 888,846

[22] Filed: Mar. 22, 1978

[51] Int. Cl.[3] ..... F04B 35/04; F04B 21/04; F04B 39/14

[52] U.S. Cl. ..... 417/415; 417/550; 417/489

[58] Field of Search ..... 417/549, 550, 259, 234, 417/534, 415; 184/105 A; 74/18.2

[56] References Cited

U.S. PATENT DOCUMENTS

| | | | |
|---|---|---|---|
| 1,347,082 | 7/1920 | Davis | 417/549 |
| 1,662,842 | 3/1928 | Albortine | 184/105 A |
| 1,858,036 | 5/1932 | Brown | 417/259 |
| 1,930,297 | 10/1933 | Welch | 417/238 |
| 1,960,389 | 5/1934 | McFerran, Jr. | 417/415 |
| 2,945,444 | 7/1960 | Leissner | 417/360 |
| 2,984,190 | 5/1961 | Dibley et al. | 417/550 |
| 3,066,610 | 12/1962 | Swanson | 417/234 |
| 3,145,018 | 8/1964 | Goodwiller | 403/362 |
| 3,291,350 | 12/1966 | Malec | 417/489 |
| 3,437,043 | 4/1969 | Sanders et al. | 417/549 |
| 4,077,494 | 3/1978 | Spaude et al. | 184/105 A |

FOREIGN PATENT DOCUMENTS

| | | | |
|---|---|---|---|
| 74369 | 11/1960 | France | 417/415 |
| 446657 | 3/1949 | Italy | 417/534 |
| 731560 | 6/1955 | United Kingdom | 417/259 |
| 1210199 | 10/1970 | United Kingdom | 184/105 A |
| 1294883 | 11/1972 | United Kingdom | 417/415 |

*Primary Examiner*—William L. Freeh
*Attorney, Agent, or Firm*—Wendell Coffee

[57] ABSTRACT

A hand carried, motor driven pump which will pump at high or low pressure, depending upon the size of the plunger used. The pump is used for high pressure lubricant, up to 9,000 lbs., to a high volume of fluid, such as Diesel oil, water and the like at low pressure. The pump is used in practically all industries in which machinery is to be lubricated by grease under high pressure and where liquids need to be transferred or pumped from one container to another. The present pump is particularly adaptable for use on heavy agricultural machinery, where portability is essential.

2 Claims, 8 Drawing Figures

PORTABLE, HAND HELD, HIGH PRESSURE PUMP

SUMMARY OF THE INVENTION

This invention relates to portable, high pressure pumps, and more particularly to a motor driven, high pressure pump for pumping flowable liquids, and is particularly adaptable to pumping viscous lubricants used in the lubrication of Alemite and Zerk fittings and the like, and is particularly adaptable for use in remote areas where commercial, air actuated equipment is not available. The present device will operate at both high and low pressure.

The present pump will operate either on AC or DC electrical current or on six or twelve volt DC current.

When used as a lubricating device, it is constructed with a small high speed motor which operates a reciprocating pump to withdraw lubricant from a fillable container or from a cartridge within a container so that the lubricant may be dispensed at pressures ranging from 3,000 pounds or higher, depending on the size of the plunger and the size of the cylinder. The plunger and cylinder may be readily exchanged for smaller or larger sizes, depending on the pressure desired. Furthermore, the device may be adapted to the use of a regular hand type grease gun barrel container in connection therewith, which container may use either bulk lubricant therein or a standard cartridge, whereby the lubricant is fed directly therefrom into the cylinder of the pump by spring pressure, which urges the lubricant from the container into the pump cylinder.

OBJECTS OF THE INVENTION

An object of this invention is to provide lubricating pump equipment of a character which will dispense viscous lubricant and the like through a hose connected to the outlet of the pump to enable the ready lubrication of a lubricant fitting.

Another object of the invention is to provide a light weight, hand carried, motor driven, high speed lubricant dispensing mechanism which will accurately dispense lubricant, under pressure, to the desired fitting.

Still another object of the invention is to provide a high speed, motor driven pump to dispense lubricant or other liquid, under high pressure, which is light in weight and can be hand carried without being a burden to the operator.

Yet another object of the invention is to provide an electrically driven, high pressure pump for dispensing lubricant and the like, which pump may be readily installed on a "hand type" grease gun barrel, which device may be used to dispense lubricant therefrom either in bulk or from a conventional lubricating cartridge.

A further object of the invention is to provide a motor driven, portable pumping unit which will dispense lubricant or the like, under pressure, in which it is possible to vary the pressure by changing the size of parts of the unit.

Still another object of the invention is to provide a motor driven, portable pump unit which will pump a relatively large volume of fluid under low pressure.

Yet a further object of the invention is to provide a motor driven, portable pump with a cupped plunger unit which will pump a large volume of fluid under low pressure.

DETAILED DESCRIPTION OF THE INVENTION

Figure 1:
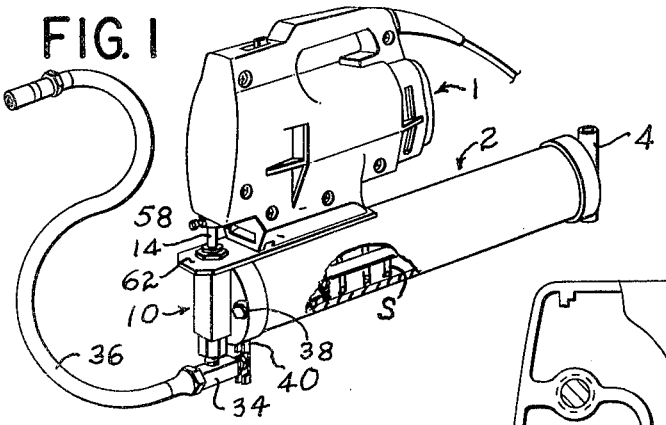
FIG. 1 is a perspective view of a high speed motor connected to a high pressure pump, showing the motor and pump installed on a conventional type lubricant gun barrel, which gun barrel is shown to have a handle to compress a spring (not shown) to release the spring so that the lubricant is fed to the cylinder to be dispensed, and showing a hose attached thereto for connection with a lubricant fitting.

With more detailed reference to the drawing in which like numerals designate like parts in the several views thereof, the numeral 1 designates generally a high speed motor with a geared reciprocating plunger mechanism connected thereto and made integral therewith, which high speed motor 1 is shown to be mounted on a lubrication reservoir, designated generally at 2, such as used with hand guns, and which has a handle 4 thereon, which handle connects with a compression spring therein, in a manner well known in the art of lubrication containers for hand guns. The spring (not shown) urges the lubricant within the reservoir 2 toward lubricant outlet opening 6 in the cap 8 at the discharge end of the container. The cap 8 is welded, or otherwise secured, to a pump cylinder housing or pump block assembly, designated generally at 10, so as to convey the lubricant out through opening 6 into opening 12 in the pump block assembly 10.

A large plunger 14 is fitted within the bore 16 of the pump block assembly 10 in fluid tight relation, and has an O-ring sealing element 18 within the groove 20 of the plunger 14 so as to prevent leakage into the bore 16. The opening 12 intersects and connects with the bore 16 mediate the length of the bore, so that lubricant will pass from lubricant reservoir 2 through openings 6 and 12 into the bore 16 intermediate the lower end of the plunger 14 and high pressure cylinder line 22 in the bore 16 of the pump block assembly 10, so when the plunger 24, which is fitted in a socket 26 in the lower end of the plunger 14 moves downward, it will pass into the axial opening 21 of the cylinder liner, so that the lower end of the plunger 24 will enter the axial opening and force the lubricant therein downward past outlet valve 25. The outlet valve 25 is spring pressed upward against the seat 28 by spring 30, which spring is interposed between abutment 32 and the valve 25. The seat 28 is in the cylinder liner 22. Lubricant will flow downward through opening in air bleed valve 34 and into conduit 36.

In event air is entrapped within reservoir 2, this air may be bled therefrom by removing plug 38, and if air is entrapped within the cylinder, the air may be bled therefrom through air bleed valve 34 by loosening valve 40, in a manner well understood in the draining of radiators and the like. After the air is vented from the reservoir and from the cylinder, the pumping may then continue.

Figure 2:
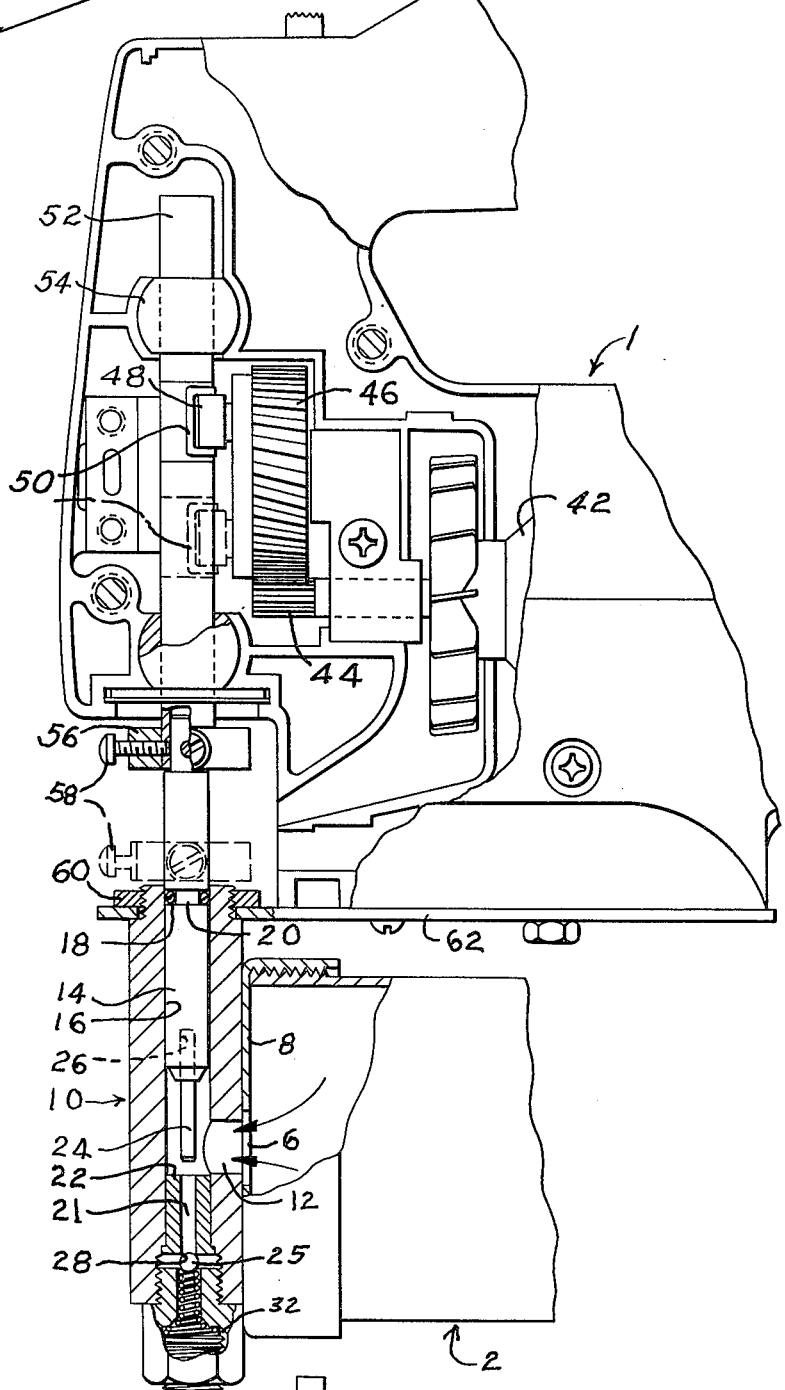
FIG. 2 is a fragmentary side elevational view of a portion of a high speed motor, with parts being broken away to show the interior construction, and with parts being shown in section to show the reciprocating pump mechanism, with a pump plunger being shown in retracted position in full outline and an alternate position thereof being shown in dashed outline, also showing a cross section through the pump cylinder, also shown is the valving mechanism and an air bleed valve.
Figure 3:
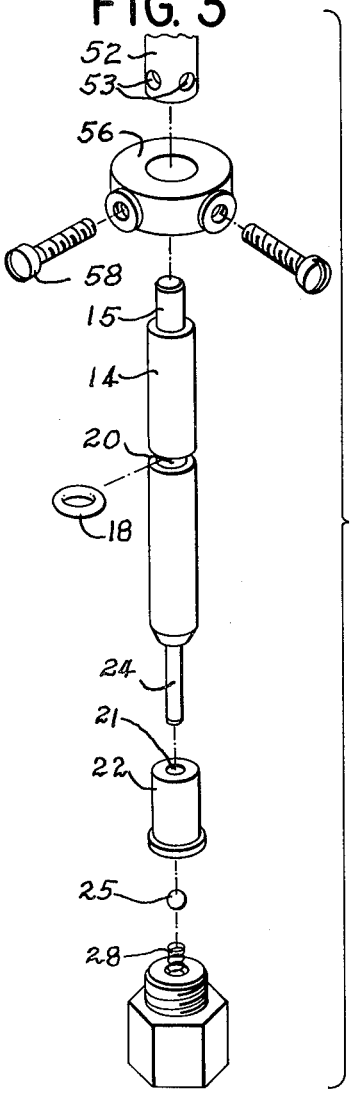
FIG. 3 is an exploded view showing the pump plunger removed from the reciprocating element of the pump, and showing the various parts associated therewith.
Figure 3:
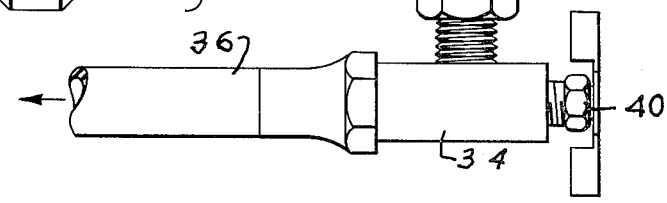
Figure 4:
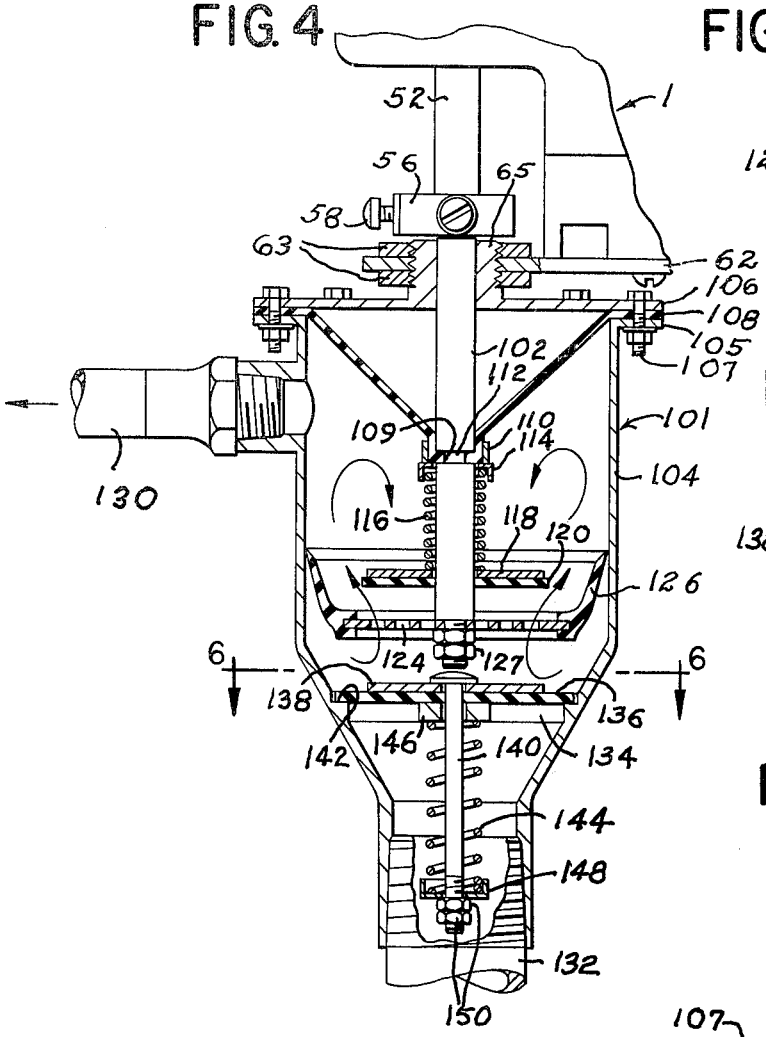
FIG. 4 is a fragmentary view of the motor and the reciprocating plunger associated therewith, and showing a modified form of pump attached to the plunger, with the pump being shown in section, and showing the inlet valve in raised position, the path of the liquid upward therethrough being indicated by the curved arrows.
Figure 5:
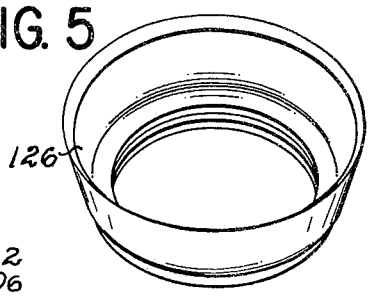
FIG. 5 is a perspective view of an elastomer cup, as shown in FIG. 4, apart from the pump.
Figure 6:
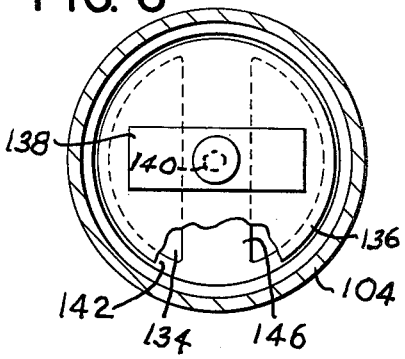
FIG. 6 is a sectional view taken on the line 6—6 of FIG. 4, looking in the direction indicated by the arrows, a portion of the valve being broken away to show the details of construction of the valve seat.

FIG. 2 shows an armature portion 42 and a gearing 44–46 connected thereto in geared relation, with a roller crank-like member 48 connected to the gear 46 to move back and forth in channel member 50 to reciprocate the plunger 52 as the gear 46 rotates. The plunger 52 is mounted in self aligning bearings 54 so that the plunger will operate axially upon rotation of gear 46, in a manner well known in reciprocation mechanisms of this nature.

The upper end of plunger 14 has a reduced portion 15 which extends into the hollow portion of the lower end of plunger 52, which enables set collar 56, having holes screw threaded therethrough to receive set screws 58 therethrough and through holes 53 in the lower end of the plunger 52 so as to interengage the reduced portion 15 of the plunger 14, as will best be seen in FIG. 2, which will prevent relative movement between these parts.

The lower end of the plunger 52 interconnects with the upper end of plunger 14 by a set screw collar 56, which enables the set collar 56 to be removed by removing the set screws 58 and by removing a jam nut 60 on the pump block assembly 10. Then assembly 10 may be removed from the base plate 62 on the lower side of the motor assembly 1, whereupon, the block assembly 10 and cap 8 may be removed with the plunger 14 and a plunger 24, of a different size substituted therefor, with a matching cylinder liner assembly 22 of a size to interfit with the plunger 24.

As seen in FIG. 2 the pump block assembly 10 extends through a hole in the base plate 62 and is held in place by the jam nut 60. The plungers 14, 24, and 52 are co-axial with the hole in the base plate 62. The pump plunger 24 and the cylinder liner 22 may be larger or smaller, so as to dispense a greater amount of lubricant at a lower pressure or a smaller amount of lubricant at a higher pressure, as desired, or, only the plunger 24 and cylinder liner 22 may be interchanged, as the socket 26, in the plunger 14, would be made of a uniform size to accommodate outwardly extending plungers of different sizes.

MODIFIED FORM OF THE INVENTION

A modified form of the invention is shown in FIGS. 1 through 8, and utilizes the same motor assembly, as described in the above form of the invention, which motor 1 is connected to a pump assembly, designated generally at 101 by set collar 56. The pump 101 is reciprocated by the plunger 52, which plunger is connected to the upper end of plunger 102 in pump assembly 101 in the same manner as plunger 14, in the above described form of the invention. The pump 101 is secured to the base plate 62 of the motor 1 by screw threaded nuts 63 which interengage upstanding screw threaded neck 65 on head 106, so as to maintain the pump 101 against relative longitudinal movement with respect to the motor 1.

The pump assembly 101 comprises a housing 104 which has the head 106 secured thereto be bolts 107 in fluid tight relation by means of a seal 108, which seal is interposed between out-turned flange 105 on the housing 104 and the head 106.

The seal 108 is yieldable, the center thereof having an inturned lip 109, which seal interengages groove 112 and is held in secure relation thereto by ring 110, so as to enable the seal 108 to reciprocate in unison with the plunger 102. An abutment is mounted on and secured to plunger 102 within the upper portion of the housing 104 and has one end of a compression spring 116 thereagainst. The opposite end of the spring 116 abuts an apertured plate 118, which apertured plate is mounted above an apertured, elastomer valve 120 and is slidable on plunger shaft 102 so as to serve as a pressure operated check valve to open and close perforate plate 124.

Figure 7:
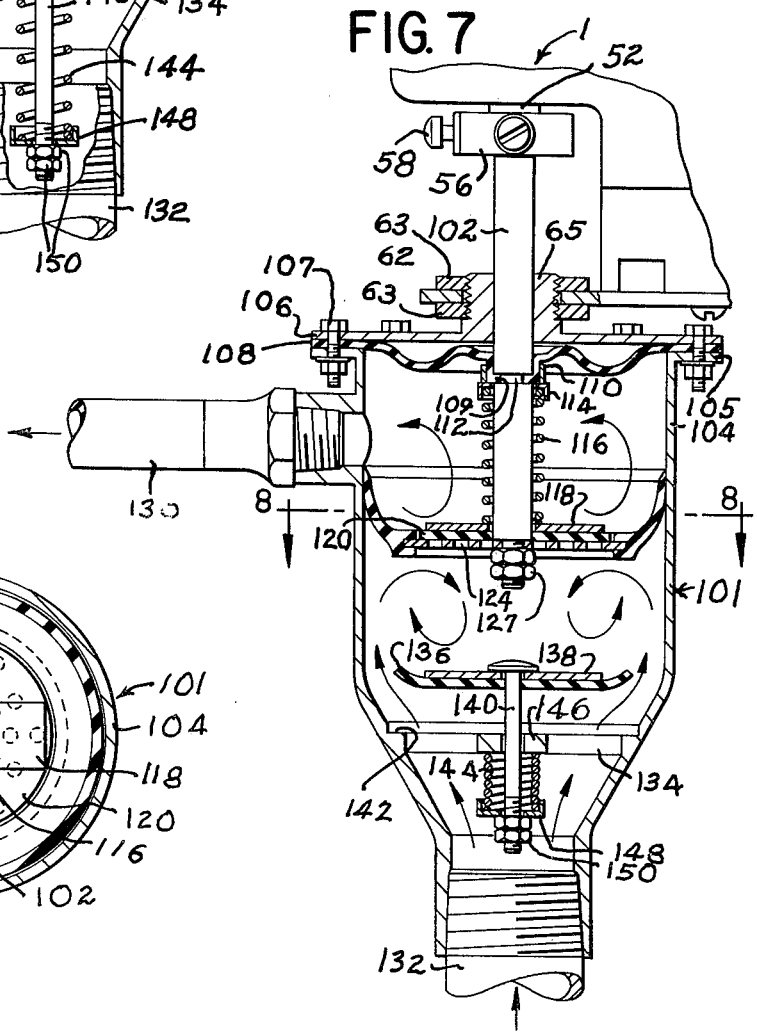
FIG. 7 is a view similar to FIG. 4 but of a pump plunger at the uppermost end of the exhaust stroke and showing the liquid being exhausted outward therethrough, as indicated by the curved arrows, with additional liquid being drawn in from below, prior to the reversal of the pump plunger and the seating of the intake valve.
Figure 8:
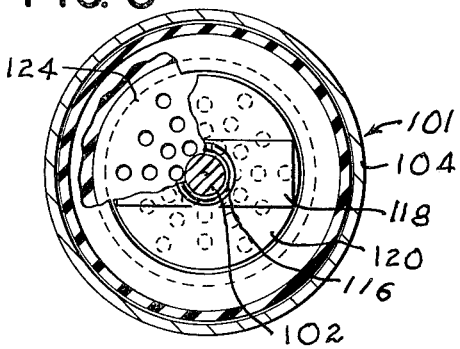
FIG. 8 is a sectional view taken on the line 8—8 of FIG. 7, looking in the direction indicated by the arrows, with parts being broken away to show the details of construction.

The plate 104 is fitted within the lower side of elastomer cup 126, so upon reciprocation of plunger 102, the cup, which is secured thereof by screw threaded nuts 127, will operate within the cylindrical housing 104 to move fluid upward when valve 120 is closed, to discharge the fluid outward through passage 128 into conduit 130, in the direction indicated by the arrows. While the elastomer cup 126 is moved upward with the valve 120 closed, as shown in FIG. 7, fluid is drawn through conduit 132, located in the bottom of housing 104, the suction of the elastomer cup 126 moves the fluid upward through passages 134 in housing 104. The elastomer valve 136 will move the plate 138 and central stem 140 upward off seat 142, as shown in FIG. 7, thereby compressing weak spring 144, which spring is interposed between the perforate cross bar 146 and an abutment 148, which spring is held in adjusted relation by nuts 150 on stem 140. When the elastomer cup 126 reaches the upper-most point of travel, the spring 116 will urge the plate 118 downward to close valve 120 against perforations 124. However, upon reversal of the movement of elastomer cup 126, the valve will open to permit it to travel above the cup until the cup reaches the lower-most point of travel, and by continuous reciprocation of plunger 102, the fluid will be moved through the body of the valve and out through conduit 130.

The present form of pump is designed to pump gases and liquids of light weight viscosity, such as Diesel oils and the like.

Having thus described the invention, what is claimed is:

1. A high speed, hand carried, motor operated pump, which pump comprises:

a. a pump cylinder housing,
   (i) a plunger mounted within said pump cylinder housing for reciprocation therein,
   (ii) an elastomer cup mounted on said plunger,
   (iii) a perforate plate on said cup,
   (iv) said plunger being connected in reciprocating relation with the motor, b. a reservoir,
   (i) a valved inlet opening in said pump cylinder housing,
   (ii) said inlet valve being interposed between said inlet opening and said elastomer cup so as to control the flow of fluid into said cylinder housing, c. an abutment formed on said plunger to form a valve seat, d. an elastomer valve operatively positioned for opening and closing the perforations of said plate,
   (i) a stem passing through said elastomer valve,
   (ii) a spring surrounding said stem and being biased between said stem and said valve seat so as to cause the elastomer valve to sit on the valve seat, when in one position,
   (iii) an elastomer seal interposed between the upper face of said cylinder housing and said elastomer cup,
   (iv) said elastomer seal being secured to said plunger intermediate said elastomer cup and the head of said cylinder housing.

2. A high speed, hand carried motor driven pump comprising:

a. a pump cylinder housing,
   (i) a pump plunger mounted within said pump cylinder housing for reciprocation therein, b. a reservoir,
   (i) an inlet opening in said pump cylinder housing,
   (ii) said pump cylinder housing being interconnected, in fluid communication, with said reservoir by means of said inlet opening, c. a high speed motor,
   (i) a motor plunger mounted within said motor for reciprocation therein by said motor,
   (ii) said pump plunger being connected co-axially in reciprocating relation with said motor plunger, d. a base plate on the lower side of the motor,
   (i) a screw threaded neck on the pump cylinder housing extending through a hole in the base plate,
   (ii) at least one jam nut holding on the threaded neck holding the pump cylinder housing to the base plate and thus the motor, e. an elastomer cup is mounted on said plunger,
   (i) a perforate plate on said cup, f. an abutment on said plunger,
   (i) a spring surrounding said plunger and being biased between said abutment and said valve operatively positioned for opening and closing said perforations in said plate, g. said inlet valve interposed between the inlet opening and said elastomer cup so as to control the flow of fluid into said cylindrical housing,
   (i) a stem passing through said elastomer valve,
   (ii) a spring surrounding said stem and being biased between said stem and said valve seat so as to cause the elastomer valve member to seat on said valve seat when in one position.

* * * * *